United States Patent [19]

Jensen

[11] Patent Number: 4,765,628

[45] Date of Patent: Aug. 23, 1988

[54] FIGHTING WEAPON

[76] Inventor: Harvey W. Jensen, 4920 Sawyer Ave., Carpinteria, Calif. 93013

[21] Appl. No.: 17,983

[22] Filed: Feb. 24, 1987

[51] Int. Cl.[4] ..... F41B 15/08

[52] U.S. Cl. ..... 273/425; D22/117; 273/84 R

[58] Field of Search ..... 273/84 R, 424, 425; 63/3, 4, 15; D21/115–118; D11/8, 11, 26, 37, 38, 70

[56] References Cited

U.S. PATENT DOCUMENTS

| | | | |
|---|---|---|---|
| D. 39,136 | 2/1908 | McDonald | D11/8 |
| D. 210,552 | 3/1968 | Pelzman | D11/11 |
| 309,426 | 12/1884 | Wickersham | 63/15 |
| 2,741,025 | 4/1956 | Stewart | D22/117 X |
| 3,648,371 | 3/1972 | Petrosky | D22/117 X |

*Primary Examiner*—Paul E. Shapiro
*Attorney, Agent, or Firm*—Jack C. Munro

[57] ABSTRACT

A fighting weapon to be usable by a human being for self-defense which comprises a cable ring member on which are loosely mounted a plurality of elongated members. Each elongated member includes a sharp outer point. The weapon is capable of being thrown through the air or can be used as a hand held weapon.

4 Claims, 1 Drawing Sheet

FIGHTING WEAPON

BACKGROUND OF THE INVENTION

The field of this invention relates to defensive weapons and more particularly to a defensive weapon which is to be usable by a human being to protect oneself from being physically accosted by another human being.

There are numerous types of weapons for self-defense. Self-defense weapons are commonly used by individuals who are subjected to physical accostations such as being mugged. The desirable form of a self-defense weapon would be a firearm. However, within most municipalities, use of a firearm is prohibited.

Therefore, it is common to use some other form of self-defense mechanism. Certain individuals have taken up karate or judo. However, some people are just not physically able to learn karate or judo. Also, some people may not be able to afford the time or expense to learn karate or judo.

Other types of defensive weapons may encompass something like a knife. However, to carry a knife blade represents a hazard not only to the assailant but also to the user prior to being used.

A known type of defensive weapon is what is frequently termed a "throwing star". The throwing star resembles the shape of a star in which each of the sharp points of the star constitutes a sharpened knife edge. Upon the item being thrown at the assailant, generally minor cutting of the assailant's body occurs upon being struck. When the assailant is struck and is caused to bleed, such generally deters accostation by the assailant.

SUMMARY OF THE INVENTION

The structure of the present invention relates to the construction of a throwing star which can be usable not only as a throwing weapon but also is capable of being hand held and usable in conjunction with physical blows directed against the assailant. The structure of the present invention takes the form of a small ring which is formed of a small diametered cable. Mounted on the ring are a plurality of elongated members. Each elongated member is capable of freely swiveling on the ring. The free or outer end of each elongated member terminates in a sharp point. To maintain the small amount of separation between the elongated members, there is also mounted on the ring a spacing member. There is to be a spacing member located between each directly adjacent pair of elongated members. Each spacing member is also freely swivelable on the ring member.

DETAILED DESCRIPTION OF THE SHOWN EMBODIMENT

Figure 1:
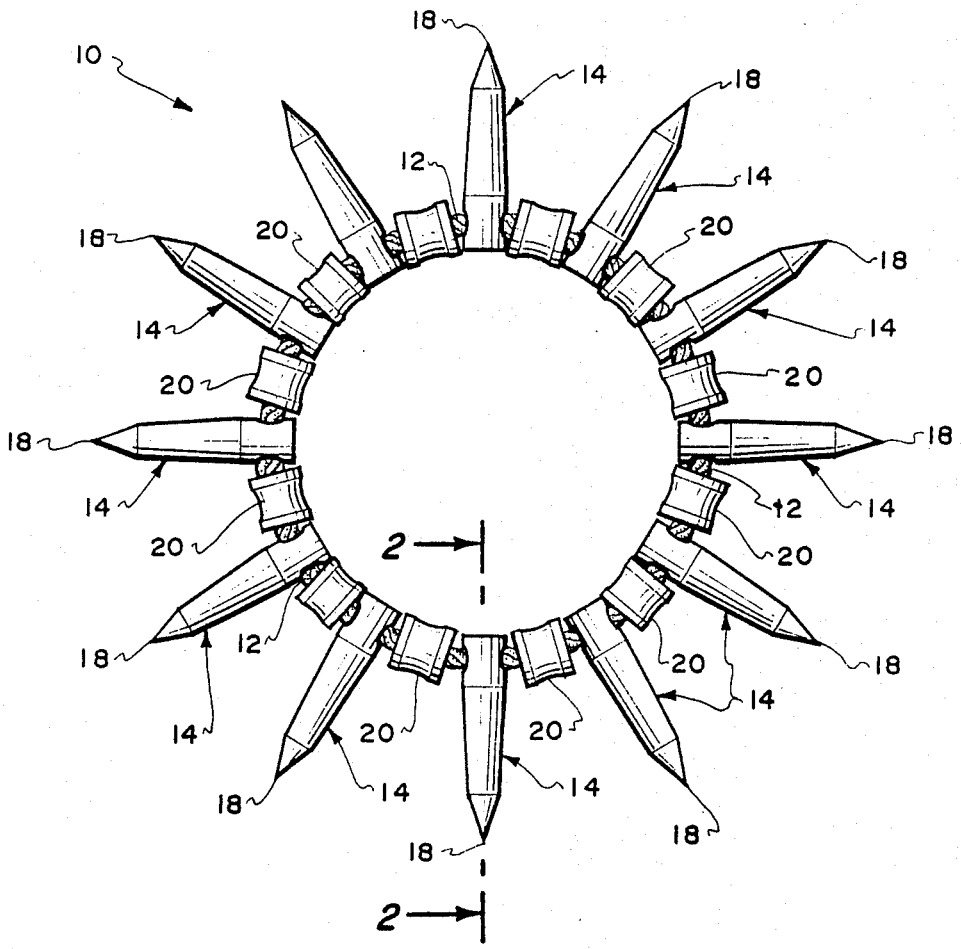
FIG. 1 is a top plan view of the fighting weapon of the present invention showing the fighting weapon in a position of usage if the weapon was thrown through the air.

Referring particularly to the drawing there is shown the fighting weapon 10 of this invention which has a main support member in the form of a ring member 12.

This ring member 12 is sowewhat flexible but does assume the shape shown in the drawing when naturally at rest. A desirable material of construction for the ring member would be a twisted helical cable. This ring member 12 can be constructed of any desirable material, generally a metal cable being preferred.

The fighting weapon 10 includes a plurality of elongated members 14 with therebeing shown twelve in number of such elongated members 14. However, it is considered to be within the scope of this invention that the number of members 14 can be increased or decreased without departing from the scope of this invention. The basic material of construction of each member 14 will normally be metal such as stainless steel. However, again, the material of construction can be altered without departing from the scope of this invention.

Figure 2:
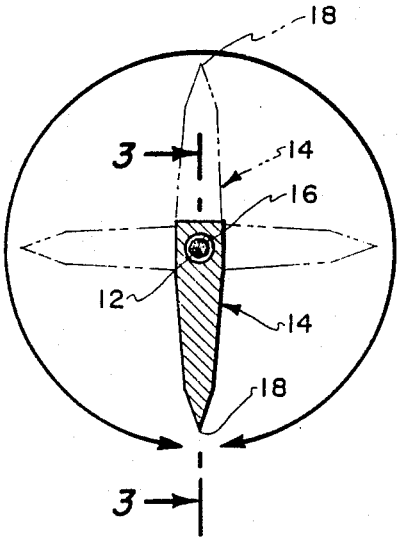
FIG. 2 is a cross-sectional view taken along line 2—2 of FIG. 1 depicting the range of movement of each of the elongated members which are part of the fighting weapon shown in FIG. 1.
Figure 3:
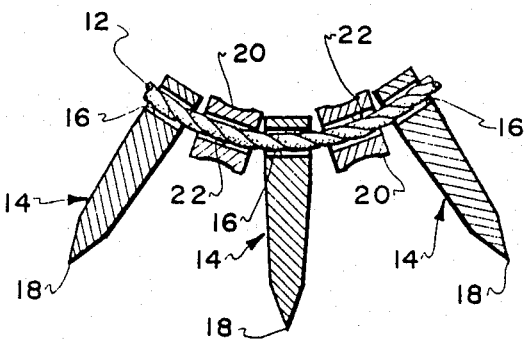
FIG. 3 is a cross-sectional view taken along line 3—3 of FIG. 2.

Each of the elongated members 14 are identical to one another. Each member 14 has a through hole 16 formed through the inner end of the elongated member 14. The outer or free end of each elongated member 14 assumes a sharpened point 18. Ring member 12 is conducted through each of the through holes 16 with the ring member 12 assuming a loose fit with respect to the wall of the through hole 16. As a result, each elongated member 14 is capable of being freely swiveled on the ring member 12. This swiveling action is depicted generally by the series of dotted line positions within FIG. 2 of the drawing.

It is desired that the elongated members 14 be maintained in a certain spacing in respect to each other. In order to maintain the spacing, there is included between each directly adjacent pair of members 14 a spacing member 20. This spacing member 20 is basically in the shape of a small spool and has a through hole 22 formed therein. The size of the through hole 22 is basically identical to the size of the through hole 16. The ring member 12 is conducted through the hole 22. It is to be understood that there is also twelve in number of the spacing members 20.

In order to use the fighting weapon 10, a human being may tightly grasp the ring member 12 about two or three in number of the elongated members 14 and also two and three in number of the spacing members 20. By slightly deforming of the ring member 12 to a non-circular configuration, the elongated members 14 can be made to assume a fixed configuration with eight or nine of the elongated members 14 extending outwardly as shown in FIG. 1 of the drawing. The operator can then use the fighting weapon 10 as a slashing weapon against an assailant with the sharp points 18 of the eight or nine elongated members 14 each functioning as a cutting instrument against the body of the assailant.

Also, the weapon 10 can be used as a throwing weapon at which time the weapon 10 is thrown like a flying disc at the assailant. When the fighting weapon 10 is thrown through the air, the ring member 12 is to be spun in a circular motion. This spinning of the ring member 12 will inherently cause each of the elongated members 14 to be located by centrifugal force in the extended position as shown in FIG. 1. Therefore, upon the sharp pointed elongated members 14 coming into contact with the assailant, an injury will normally result.

What is claimed is:

1. A fighting weapon comprising:

a ring member, said ring member being flexible but having sufficient rigidity to assume a circular shape when at rest; and a plurality of identical elongated members, each said elongated member having an inner end and an outer end, said inner end including a through hole, said outer end being formed into a sharp point, said ring member being located within said through hole and forming a loose connection with each said elongated member, said elongated members being substantially evenly spaced apart forming in essence a continuous circular shaped device, each said elongated member being readily swivelable on said ring member, whereby said sharp point of each said elongated member is to be usable as an injury producing member against an assailant, whereby when said ring member is used as a hand held weapon the said ring member is sufficiently rigid to substantially remain in said circular shape.

2. The fighting weapon as defined in claim 1 wherein:

a spacing member located between each directly adjacent pair of said elongated members, said spacing members functioning to maintain said substantially even spacing between said elongated members, said spacing members being identical, said spacing members being substantially smaller in size than said elongated members.

3. The fighting weapon as defined in claim 2 wherein:

each said spacing member being loosely mounted on said ring member.

4. The fighting weapon as defined in claim 1 wherein:

said ring member comprising a cable.

* * * * *